US008356491B2

(12) United States Patent
Taras et al.

(10) Patent No.: US 8,356,491 B2
(45) Date of Patent: Jan. 22, 2013

(54) REFRIGERANT SYSTEM WITH INTERCOOLER UTILIZED FOR REHEAT FUNCTION

(75) Inventors: Michael F. Taras, Fayetteville, NY (US); Alexander Lifson, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 939 days.

(21) Appl. No.: 12/447,492

(22) PCT Filed: Dec. 21, 2006

(86) PCT No.: PCT/US2006/049019

§ 371 (c)(1),
(2), (4) Date: Apr. 28, 2009

(87) PCT Pub. No.: WO2008/076122

PCT Pub. Date: Jun. 26, 2008

(65) Prior Publication Data

US 2010/0071407 A1 Mar. 25, 2010

(51) Int. Cl.
*F25B 41/00* (2006.01)

(52) U.S. Cl. ..... 62/513

(58) Field of Classification Search ..... 62/513, 62/498, 500, 510

See application file for complete search history.

(56) References Cited

U.S. PATENT DOCUMENTS

| | | | | |
|---|---|---|---|---|
| 6,889,512 | B2 | 5/2005 | Ebara et al. | |
| 7,131,294 | B2 | 11/2006 | Manole | |
| 2003/0109963 | A1 | 6/2003 | Oppedisano et al. | |
| 2003/0192338 | A1 | 10/2003 | Manohar | |
| 2004/0007006 | A1 | 1/2004 | Ebara | |
| 2005/0210910 | A1 | 9/2005 | Rigney et al. | |
| 2006/0010906 | A1 * | 1/2006 | Taras et al. | 62/513 |
| 2006/0010908 | A1 * | 1/2006 | Taras et al. | 62/513 |
| 2006/0090507 | A1 | 5/2006 | Taras | |

FOREIGN PATENT DOCUMENTS

| | | |
|---|---|---|
| DE | 19548458 | 6/1997 |
| EP | 1347251 | 9/2003 |
| JP | 2004116957 A | 4/2004 |
| WO | 2008057090 | 5/2008 |

OTHER PUBLICATIONS

Supplementary European Search Report, dated Oct. 23, 2009.
Search Report and Written Opinion mailed on Oct. 2, 2007 for PCT/US06/49019.
International Preliminary Report mailed Jun. 8, 2011.

* cited by examiner

*Primary Examiner* — Melvin Jones
(74) *Attorney, Agent, or Firm* — Carlson, Gaskey & Olds, PC

(57) ABSTRACT

A refrigerant system is provided with at least two stages of compression connected in series. An intercooler is positioned intermediate the two stages and is cooled by an indoor air stream. The intercooler is positioned to be in a path of air flow passing over an indoor heat exchanger, and preferably downstream of the indoor heat exchanger, in relation to this airflow. The intercooler cools the refrigerant flowing between the two compression stages as well as provides the reheat function. Benefits with regard to system performance (efficiency, capacity and reliability) are achieved with no additional circuitry or components required to provide the intercooler and reheat functions. This invention is particularly important for the $CO_2$ refrigerant systems operating in the transcritical cycle. Methods of control are presented for both the intercooler and reheat functions.

18 Claims, 1 Drawing Sheet

REFRIGERANT SYSTEM WITH INTERCOOLER UTILIZED FOR REHEAT FUNCTION

This application is a United States National Phase application of PCT Application No. PCT/US2006/049019 filed Dec. 21, 2006.

BACKGROUND OF THE INVENTION

This application relates to a refrigerant system, wherein the compressor is a two-stage compressor, and wherein an intercooler is provided between the two compression stages. The intercooler is placed in the air stream moving over an indoor heat exchanger, and preferably downstream of an indoor heat exchanger, in relation to the airflow, such that an intercooler heat exchanger also provides a reheat function.

Refrigerant systems are known and utilized to condition a secondary fluid, such as air to be delivered into a climate controlled environment. Typically, a compressor compresses a refrigerant and delivers that refrigerant to an outdoor heat exchanger, known as a condenser for subcritical applications and as a gas cooler for transcritical applications. From the outdoor heat exchanger, the refrigerant passes through an expansion device, and then to an indoor heat exchanger, known as an evaporator.

To obtain additional capacity, enhance system efficiency and achieve higher compression ratios, it is often the case that a two-stage compressor is provided in a refrigerant system. With a two-stage compressor, two separate compressor members or two separate compressor units are disposed in series in a refrigerant system. Specifically, for instance, in the case of a reciprocating compressor, two separate compression members may be represented by different banks of cylinders connected in series. Refrigerant compressed by a lower stage to an intermediate pressure is delivered from a discharge outlet of this lower stage to a suction inlet of a higher stage. If the compression ratio for the compressor system is high (which is typically the case for two-stage compression systems) and/or refrigerant suction temperature is high (which is often the case for a refrigerant system equipped with liquid-suction heat exchanger), then refrigerant discharge temperature can also become extremely high, and in many cases, may exceed the limit defined by safety or reliability considerations. Thus, it is known in the art to provide an intercooler heat exchanger (or a so-called intercooler) between the two compression stages to extend the operational envelope and/or improve system reliability. In the intercooler, refrigerant flowing between the two compression stages is typically cooled by a secondary fluid. Typically, additional components and circuitry are required to provide cooling in the intercooler. As an example, a fan or pump is supplied to move a secondary cooling fluid from a cold temperature source to cool the refrigerant in the intercooler. This increases the cost of providing the intercooler function.

Another optional refrigerant system feature is a reheat circuit. In a reheat circuit, a refrigerant is passed through a heat exchanger located downstream in the path of air having passed over an evaporator. A control for the refrigerant system may then control the evaporator such that it will initially cool the air below a temperature that is desired by an occupant of the environment to be conditioned. This allows the removal of extra moisture amount from the air. The air then passes downstream over the reheat heat exchanger, and is warmed back to the desired temperature. The reheat circuit provides the ability to remove additional moisture from the air stream, when dehumidification is desired and no or little cooling is required. Typically, provision of a reheat circuit does require an additional heat exchanger, however, it does not require an additional air-moving device as it relies upon the air-moving device that is already provided to move air over the evaporator.

Recently, new generation refrigerants, such as natural refrigerants, are being utilized in refrigerant systems. One very promising refrigerant is carbon dioxide (also known as $CO_2$ or R744). Particularly with $CO_2$ refrigerant systems, the intercooler becomes even more important as these systems tend to operate at high discharge temperatures due to high operating pressures, frequent use of liquid-suction heat exchanger, and, in general, by the transcritical nature of the $CO_2$ cycle, as well as a high value of the polytropic compression exponent for the $CO_2$ refrigerant. However, the additional cost of the circuitry and components associated with the intercooler makes the provision of an intercooler less desirable.

Thus, it is desirable to provide an intercooler for a multi-stage compressor refrigerant system, and particularly for a $CO_2$ refrigerant system, as well as a reheat function, that essentially does not require any additional circuitry or components beyond the intercooler itself.

SUMMARY OF THE INVENTION

In a disclosed embodiment of this invention, a refrigerant system incorporates a multi-stage compressor. An intercooler is provided between at least two of the compression stages connected in series. The intercooler is positioned to be subjected to the airflow passing over an indoor heat exchanger. Preferably, the intercooler is positioned downstream of the indoor heat exchanger, with respect to the airflow delivered to a conditioned space. Thus, the intercooler heat exchanger may also selectively provide the reheat function, preferably at operating conditions when dehumidification with little or no cooling is desired. The reheat function and the intercooler function may be activated on demand. For instance, a refrigerant bypass around the intercooler may be provided when the intercooler function is not required and/or an air damper may be installed to bypass airflow around the intercooler in cases when the reheat function is not needed.

Positioning the intercooler in the indoor air stream allows for a single heat exchanger to provide both the intercooler and reheat functions. Moreover, by positioning the intercooler downstream of the indoor heat exchanger, an additional air-moving device associated with the intercooler is not required. Instead, the air-moving device that is already associated with the evaporator also moves air across the intercooler heat exchanger. In this way, both a reheat function and an intercooler function are provided with only the provision of a single heat exchanger.

In this invention, when the refrigerant system is operating in a dehumidification mode, an indoor air-moving device that passes air over the indoor heat exchanger also cools the refrigerant flowing in the intercooler between the lower and higher compression stages. The intercooler increases refrigerant system capacity and improves efficiency, since the compressor discharge temperature is reduced, and the outdoor heat exchanger (a condenser or a gas cooler) is capable to cool refrigerant to a lower temperature, providing a higher cooling potential in the evaporator.

Additionally, if the system operates in a transcritical cycle, such as a $CO_2$ transcritical cycle, where the high side temperature and pressure are independent from each other, the discharge pressure is not limited by a discharge temperature anymore and can be adjusted to the value providing an optimum performance level. Thus, efficiency and capacity of the refrigerant system will be enhanced even further.

These and other features of the present invention can be best understood from the following specification and drawings, the following of which is a brief description.

DETAILED DESCRIPTION OF THE PREFERRED EMBODIMENTS

Figure 1A:
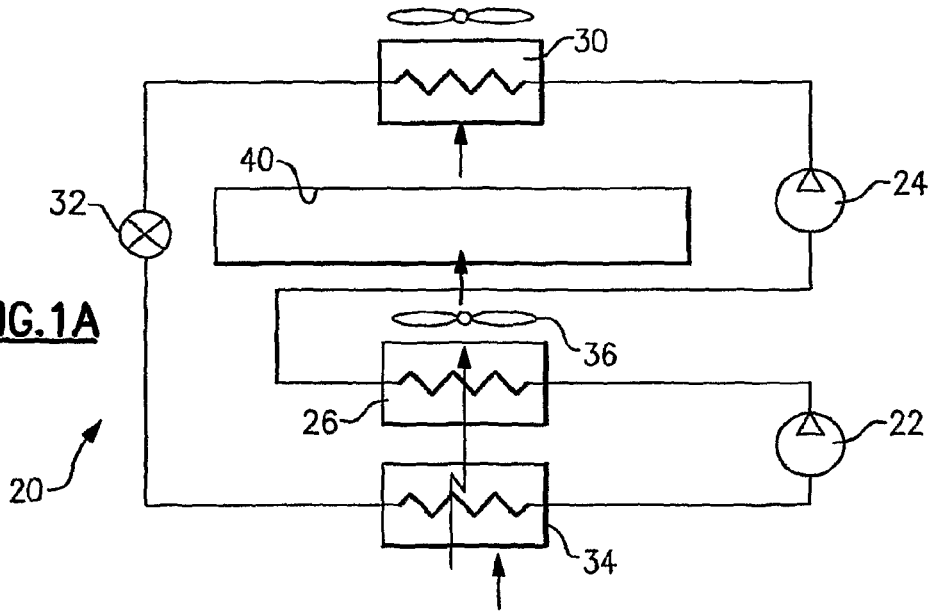
FIG. 1A shows a schematic of an inventive refrigerant system.

A refrigerant system 20 is illustrated in FIG. 1A having a lower stage compressor 22 and a higher stage compressor 24. While only two stages are shown, additional stages may also be incorporated in series in this invention. Also, instead of separate compressors connected in sequence, a multi-stage compressor arrangement can be employed and equally benefit from the present invention. For instance, the two separate compression members (22 and 24) may represent different banks of cylinders connected in series for a reciprocating compressor. As known, refrigerant compressed by a lower stage to an intermediate pressure is delivered from a discharge outlet of this lower stage to a suction inlet of the higher stage. An intercooler 26 is positioned between the two stages to accept refrigerant from a discharge outlet of the lower stage 22, cool it by a secondary media (fluid), such as air to be delivered to a conditioned space blowing over external heat transfer surfaces of the intercooler 26 during heat transfer interaction with the refrigerant, and deliver it downstream to a suction inlet of the higher stage 24. Again, if additional stages of compression are provided, additional intercoolers may also be positioned between those stages.

Refrigerant is compressed at the low stage compressor 22 from a suction pressure to an intermediate pressure, flows through the intercooler 26, where it is cooled by a secondary media such as indoor air, compressed from an intermediate pressure to a discharge pressure at the higher stage compressor 24, and then delivered to an outdoor heat exchanger (a condenser for subcritical applications or a gas cooler for transcritical applications) 30. From the outdoor heat exchanger 30, the refrigerant passes through an expansion device 32, where it is expanded from a pressure typically approximating the discharge pressure to a pressure approximating the suction pressure, while its temperature is reduced, and then flows to an evaporator 34. From the evaporator, refrigerant returns to the lower stage compressor 22.

An air-moving device 36 blows air over external surfaces of the evaporator 34. That air is delivered into a climate controlled environment 40. As can be appreciated in FIG. 1A, the intercooler 26 is positioned to be in the path of air having flowed over the evaporator 34, and driven by the air-moving device 36.

As is known, a control for the refrigerant system 20 may control the condition of the refrigerant in the evaporator 34 such that it cools this air to a temperature below that desired by an occupant of the climate controlled environment 40. In this manner, an additional amount of moisture may be removed from the air, as desired. The air then serially passes over the intercooler 26, and can be heated back to the temperature that is desired in the conditioned environment 40. As the refrigerant in the intercooler heats the air delivered to the conditioned environment 40, the refrigerant itself is cooled, enhancing performance (capacity, efficiency and reliability) of the refrigerant system 20. Thus, both the reheat function and the intercooler function are provided with only the requirement of the single additional heat exchanger 26.

When the refrigerant system 20 is operating in the cooling mode, the intercooler 26 increases system capacity and efficiency, since the compressor discharge temperature is reduced and the outdoor heat exchanger 30 (once again, a condenser or a gas cooler) is capable to cool refrigerant to a lower temperature, providing a higher cooling potential for the refrigerant entering the evaporator 34. Required compressor power is also reduced as heat is removed from the compression process, and the outdoor heat exchanger 30 operating pressure is reduced as well. Additionally, if the refrigerant system 20 operates in a transcritical cycle, such as a $CO_2$ transcritical cycle, where the high side temperature and pressure are independent from each other, the discharge pressure is not limited by a discharge temperature anymore and can be adjusted to a value corresponding to an optimum performance level. Additionally, in both subcritical and transcritical cycles, the temperature of the refrigerant discharged from the higher compression stage 24 is reduced, improving reliability of the compressor. Thus, performance (efficiency and capacity) of the refrigerant system 20 is increased and compressor reliability is improved.

The present invention is particularly useful in heat pumps that utilize $CO_2$ as a refrigerant, since the $CO_2$ refrigerant has a high value of a polytropic compression exponent, and discharge operating pressures and pressure ratios of such systems can be very high, promoting higher than normal discharge temperatures. Still, the invention would extend to refrigerant systems utilizing other refrigerants.

It should be noted that this invention is not limited to the system shown in the FIG. 1A, as the actual refrigerant system may include additional components, such as, for example, a liquid-suction heat exchanger, a reheat coil, an additional intercooler, an economizer heat exchanger or a flash tank. Also, the individual compression stages may include several compressors arranged in tandem. The compressors can be of variable capacity type, including variable speed and multi-speed configurations. Further, the compressors may have various unloading options, including intermediate pressure to suction pressure bypass arrangements. On the other hand, the compressors may be unloaded internally, as for example, by separating fixed and orbiting scrolls from each other on an intermittent basis. These system configurations are also not limited to a particular compressor type and may include scroll compressors, screw compressors (single or multi-rotor configurations), reciprocating compressors (where, for example, some of the cylinders are used as a lower compression stage and the other cylinders are used as a higher compression stage) and rotary compressors. The refrigerant systems may also consist of multiple separate circuits. The present invention would also apply to a broad range of systems, for example, including mobile container units, truck-trailer and automotive systems, packaged commercial rooftop units, supermarket installations, residential units, environmental control units, etc.

Figure 1B:
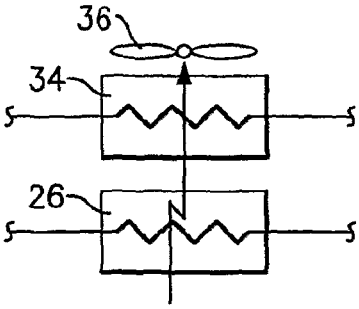
FIG. 1B shows an alternative arrangement.

Also, it should be understood that, in some cases, it would be beneficial to position the intercooler 26 upstream of the evaporator 34, with respect to the indoor airflow. For instance, if the evaporator 34 has an undesirably low sensible heat ratio (the ratio of sensible and latent capacities) or if the capacity of the evaporator 34 needs to be increased, the intercooler 26 may be positioned upstream of the evaporator 34, in these applications, as shown in FIG. 1B.

Figure 2:
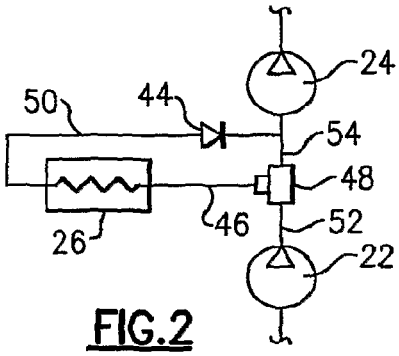
FIG. 2 shows an intercooler refrigerant bypass arrangement.

FIG. 2 exhibits another embodiment of the present invention, where a three-way valve 48 is positioned between the lower compression stage 22 and the higher compression stage 24 and allows for a selective refrigerant bypass of the intercooler 26 when the intercooler or/and reheat functions are not required. In such cases, the control (not shown) for the refrigerant system 20 moves the three-way valve 48 to a bypass position, so that the refrigerant flows directly from the lower compression stage 22 to a bypass line 52, through the three-way valve 48, to a bypass line 54 and then to the higher compression stage 24. Therefore, in this mode of operation, the intercooler 26 is eliminated from an active refrigerant circuit. On the other hand, when the intercooler function or/and the reheat function is required, the three-way valve 48 is moved to a conventional position, so that the refrigerant flow through intercooler 26 (as well as interconnecting lines 46 and 50) is allowed, and the refrigerant system 20 resumes its normal operation as described above. Further, a check valve 44 may be placed on the interconnecting line 50, to prevent refrigerant migration when the intercooler 26 is eliminated from an active refrigerant circuit.

The three-way valve 48 can be replaced by a pair of conventional valves, as known in the art. Further, if a more flexible control is required for the reheat or/and intercooler functions, the three-way valve 48 (or a substituting pair of conventional valves) may be operated in pulsation or modulation mode by a control for the refrigerant system 20.

Figure 3:
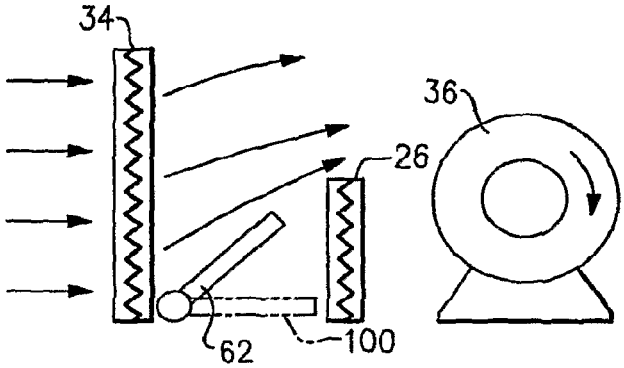
FIG. 3 shows an intercooler air bypass arrangement.

FIG. 3 shows yet another embodiment of the present invention. In this design, an indoor air baffle (or damper) is positioned between the evaporator 34 and intercooler 26, with respect to indoor airflow. If the damper 62 is inactive (position 100), both reheat and intercooler functions are engaged, since indoor air stream flows over the external surfaces of the intercooler 26. In cases when the reheat function is not required, the indoor air baffle 62 may be actuated by the control (not shown) for the refrigerant system 20. When the indoor air baffle 62 is raised, it prevents the indoor air from flowing over the external surfaces of the intercooler 26, thus depressing the reheat function. Even though no active convection heat transfer is taking place in the intercooler 26 with the indoor air baffle 62 actuated, some limited intercooler function will be still provided, since the intercooler 26 is positioned within the cold section of the refrigerant system 20.

Moreover, if a more flexible control is required for the reheat or intercooler functions, the indoor air baffle 62 may be controlled continuously or discretely to a number of intermediate positions between fully actuated and non-actuated positions.

Also, it has to be understood that the indoor air baffle 62 can be replaced by other means of the indoor airflow control, such as, for instance, a stack of louvers or any other technique known in the art.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A refrigerant system comprising:

a compressor assembly including at least two stages of compression connected in series, with a lower compression stage compressing refrigerant from a suction pressure to an intermediate pressure and passing this refrigerant to a higher compression stage compressing refrigerant from an intermediate pressure to a discharge pressure and with an intercooler positioned intermediate of said lower and higher compression stages;

an outdoor heat exchanger positioned downstream of said compressor assembly;

an expansion device positioned downstream of said outdoor heat exchanger and an indoor heat exchanger positioned downstream of said expansion device;

an air-moving device for moving air over said indoor heat exchanger, and said intercooler being positioned such that it is in the path of airflow driven by said air-moving device; and a flow control device positioned on a discharge line of said lower compression stage, and between said lower compression stage and said intercooler, said refrigerant flow control device operable to move between an open position at which it allows refrigerant downstream of said lower compression stage to enter said intercooler, and said flow control device being movable to a bypass position at which the fluid downstream of said lower compression stage will bypass said intercooler and pass to said higher compression stage.

2. The refrigerant system as set forth in claim 1, wherein said intercooler is positioned downstream of said indoor heat exchanger, in relation to an airflow path.

3. The refrigerant system as set forth in claim 1, wherein said intercooler is positioned upstream of said indoor heat exchanger, in relation to an airflow path.

4. The refrigerant system as set forth in claim 1, wherein a refrigerant in said refrigerant system is $CO_2$.

5. The refrigerant system as set forth in claim 1, wherein said at least two compression stages are positioned within one compressor.

6. The refrigerant system as set forth in claim 1, wherein said at least two compression stages are represented by separate compressors.

7. The refrigerant system as set forth in claim 1, wherein the refrigerant system operates at least in part in the transcritical cycle.

8. The refrigerant system as set forth in claim 1, wherein the refrigerant system operates at least in part in the subcritical cycle.

9. The refrigerant system as set forth in claim 1, wherein at least one compression stage is an independent compressor.

10. The refrigerant system as set forth in claim 1, wherein said at least two compression stages include at least one reciprocating compressor.

11. The refrigerant system as set forth in claim 1, wherein said at least two compression stages include at least one scroll compressor.

12. The refrigerant system as set forth in claim 1, wherein said refrigerant flow control device is one of a three-way valve and a pair of conventional solenoid valves.

13. The refrigerant system as set forth in claim 1, wherein said refrigerant flow control device can be modulated or pulsated to control at least one of the reheat function and the intercooler function.

14. A refrigerant system comprising:

a compressor assembly including at least two stages of compression connected in series, with a lower compression stage compressing refrigerant from a suction pressure to an intermediate pressure and passing this refrigerant to a higher compression stage compressing refrigerant from an intermediate pressure to a discharge pressure and with an intercooler positioned intermediate of said lower and higher compression stages;

an outdoor heat exchanger positioned downstream of said compressor assembly;

an expansion device positioned downstream of said outdoor heat exchanger and an indoor heat exchanger positioned downstream of said expansion device;

an air-moving device for moving air over said indoor heat exchanger. and said intercooler being positioned such that it is in the path of airflow driven by said air-moving device; and wherein there is an airflow bypass device to bypass airflow having passed over said indoor heat exchanger around said intercooler.

15. The refrigerant system as set forth in claim 14, wherein said airflow bypass device is one of a bypass baffle and a stack of louvers.

16. The refrigerant system as set forth in claim 14, wherein said airflow bypass device has at least a fully open position and a fully closed position.

17. The refrigerant system as set forth in claim 16, wherein said airflow bypass device is controlled to a number of discrete intermediate positions between said fully open position and fully closed position.

18. The refrigerant system as set forth in claim 16, wherein said airflow bypass device is controlled continuously between said fully open position and said fully closed position.

* * * * *